US010351212B2

(12) United States Patent
Jourdan et al.

(10) Patent No.: US 10,351,212 B2
(45) Date of Patent: Jul. 16, 2019

(54) SYSTEM AND METHOD FOR RECOVERING AN AUTONOMOUS UNDERWATER VEHICLE

(71) Applicant: THALES, Courbevoie (FR)

(72) Inventors: Michaël Jourdan, Plouzane (FR); Albert Tom, Ploudalmezeau (FR); Pierre Guthmann, Brest (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/773,197

(22) PCT Filed: Mar. 4, 2014

(86) PCT No.: PCT/EP2014/054149
§ 371 (c)(1),
(2) Date: Sep. 4, 2015

(87) PCT Pub. No.: WO2014/135522
PCT Pub. Date: Sep. 12, 2014

(65) Prior Publication Data

US 2016/0009344 A1 Jan. 14, 2016

(30) Foreign Application Priority Data

Mar. 5, 2013 (FR) ..... 13 00480

(51) Int. Cl.
*B63G 8/41* (2006.01)
*B63B 21/66* (2006.01)
(Continued)

(52) U.S. Cl.
CPC ..... *B63B 21/66* (2013.01); *B63B 27/36* (2013.01); *B63G 8/001* (2013.01); *B63G 8/18* (2013.01);
(Continued)

(58) Field of Classification Search
CPC ..... B63B 21/56; B63B 21/58; B63B 21/60; B63B 21/66; B63B 2021/56;
(Continued)

(56) References Cited

U.S. PATENT DOCUMENTS 3,943,875 A * 3/1976 Sanders ..... B63B 21/56 114/244
3,966,171 A * 6/1976 Hale ..... B63B 27/36 114/244
(Continued)

FOREIGN PATENT DOCUMENTS

JP S57-19691 U 2/1982
JP H02-38296 U 3/1990
(Continued)

OTHER PUBLICATIONS

Official Action in Japanese Patent Application No. 2015-560659, dated Jan. 9, 2018.

*Primary Examiner* — Daniel V Venne
(74) *Attorney, Agent, or Firm* — Baker & Hostetler LLP

(57) ABSTRACT

A recovery system for recovering an autonomous underwater vehicle from a ship, the underwater vehicle comprising a front portion referred to as the nose, the system comprising: a receiving device comprising a stop on which the nose of the underwater vehicle is capable of bearing, blocking means making it possible to secure the underwater vehicle to the stop, a flexible link intended to provide the interface between the receiving device and the ship, the flexible link being arranged so the ship pulls the assembly formed by the receiving device and the underwater vehicle on the front of the underwater vehicle when the latter is rigidly connected to the stop, stabilization means configured to make it possible to control the depth and the attitude, in particular the list and trim of the assembly formed by the receiving device
(Continued)

and the underwater vehicle when the latter is rigidly connected to the stop.

13 Claims, 12 Drawing Sheets

(51) Int. Cl.

| | |
|---|---|
| ***B63B 27/36*** | (2006.01) |
| ***B63G 8/42*** | (2006.01) |
| ***B63G 8/00*** | (2006.01) |
| ***B63G 8/18*** | (2006.01) |
| *B63B 27/16* | (2006.01) |

(52) U.S. Cl.
CPC ..... *B63G 8/42* (2013.01); *B63B 2027/165* (2013.01); *B63G 2008/002* (2013.01); *B63G 2008/004* (2013.01); *B63G 2008/005* (2013.01); *B63G 2008/008* (2013.01)

(58) Field of Classification Search
CPC ..... B63B 2021/66; B63B 2021/666; B63B 27/36; B63B 2027/165; B63G 8/001; B63G 8/14; B63G 8/18; B63G 8/42; B63G 2008/002; B63G 2008/42; B63H 19/00
USPC ..... 114/312, 313, 322, 330, 242, 244, 245, 114/249, 253; 440/33–36; 701/1, 21
See application file for complete search history.

(56) References Cited

U.S. PATENT DOCUMENTS

| | | | | |
|---|---|---|---|---|
| 5,253,605 | A * | 10/1993 | Collins | B63B 21/66 114/258 |
| 5,447,115 | A * | 9/1995 | Moody | B63C 7/00 114/312 |
| 6,600,695 | B1 * | 7/2003 | Nugent | B63G 8/42 114/312 |
| 6,854,410 | B1 | 2/2005 | King et al. | |
| 7,025,014 | B1 * | 4/2006 | Forgach | B63B 21/66 114/244 |
| 7,699,015 | B1 * | 4/2010 | Said | B63B 21/56 114/249 |
| 7,712,429 | B1 | 5/2010 | Gibson et al. | |
| 7,798,086 | B2 * | 9/2010 | Ruggaber | B63C 7/16 114/238 |
| 8,145,369 | B1 | 3/2012 | Tureaud et al. | |
| 2011/0192338 | A1 | 8/2011 | Goudeau et al. | |

FOREIGN PATENT DOCUMENTS

| | | | |
|---|---|---|---|
| JP | H07-223589 | A | 8/1995 |
| JP | 2009-208511 | A | 9/2009 |
| WO | 00/71415 | A1 | 11/2000 |
| WO | 2009/147176 | A1 | 12/2009 |
| WO | 2013/017414 | A1 | 2/2013 |

* cited by examiner

SYSTEM AND METHOD FOR RECOVERING AN AUTONOMOUS UNDERWATER VEHICLE

CROSS-REFERENCE TO RELATED APPLICATIONS

This application is a National Stage of International patent application PCT/EP2014/054149, filed on Mar. 4, 2014, which claims priority to foreign French patent application No. FR 1300480, filed on Mar. 5, 2013, the disclosures of which are incorporated by reference in their entirety.

FIELD OF THE INVENTION

The field of the invention is that of devices and methods for recovering an autonomous underwater vehicle or AUV from a ship.

BACKGROUND

The critical steps for recovering an autonomous underwater vehicle are the step of creating a connection between the ship and the underwater vehicle and the step of loading the underwater vehicle on board the ship.

Solutions are known in which a physical connection is established between the underwater vehicle and the ship by means of a flexible connection which is attached to the top of the underwater vehicle. Once this connection has been established, the underwater vehicle is lifted by means of a crane or a gantry, then the underwater vehicle is placed on board the ship. However, cranes and gantries are heavy and bulky equipment and it is desirable to avoid installing such equipment on board small ships. Moreover, during the phase of loading on board in rough seas, the underwater vehicle which is suspended on the crane or gantry is subjected to considerable movement which may cause it to strike the ship or the equipment thereof and to damage said equipment or to be damaged itself.

Solutions are known which permit these drawbacks to be remedied in which a physical connection is established between the underwater vehicle and the ship by means of a flexible connection which is attached to the front of the AUV. Once this connection has been established, the cable is wound up in order to lift the underwater vehicle on board the ship, for example, by sliding it on an inclined plane. The phase of launching the underwater vehicle into the sea is carried out by unwinding the cable.

One solution of this type comprises a receiving device which comprises receiving means having a flared shape which are capable of receiving the front part of the underwater vehicle. This receiving device comprises blocking means which permit the front part of the vehicle to be blocked in the receiving means and is connected to the ship by means of a cable fixed to the receiving means on the front of the ship so as to be able to pull the underwater vehicle from the ship by means of the cable and to lift the underwater vehicle onto the boat via an inclined plane.

Once the connection has been established with the receiving device and it has been towed by the ship, this solution has the drawback of not permitting the AUV to continue its mission of recording images of the sea bed by means of an active sonar device which is installed on board, the AUV tending to rise to the surface under the action of the force exerted by the cable which is subjected to a hydrodynamic drag force when the ship moves forward. This solution is not optimal since the AUV has limited endurance which does not permit it to carry out a mission of long duration.

SUMMARY OF THE INVENTION

An object of the invention is to remedy the aforementioned drawback.

To this end, the subject of the invention is a recovery system for recovering an autonomous underwater vehicle from a ship, the recovery system comprising:

a receiving device comprising a stop, the nose of the AUV being capable of bearing thereagainst, blocking means making it possible to fix the underwater vehicle to the stop, a flexible connection designed to provide an interface between the receiving device and the ship, the flexible connection being arranged such that the ship pulls the assembly formed by the receiving device and the AUV on the front of the AUV when said AUV is fixed to the stop.

The receiving device further comprises stabilization means which are configured so as to permit the immersion to be monitored (i.e., position, varied, or maintained), i.e. the depth, and the attitude, in particular the list and the trim of the assembly formed by the receiving device and the AUV to which it is connected.

In other words, the size and positioning of the stabilization means are defined as a function of the size, the mass and the geometry of the AUV to be recovered so as to be able to monitor (i.e., position, vary, or maintain) the depth and the attitude of the assembly.

The arrangement of the flexible connection and the stabilization means enable the AUV, once towed, to be prevented from rising to the surface of the water under the action of the force exerted by the cable when the ship moves. This arrangement makes it possible to control the depth of the assembly formed by the AUV and the receiving device in the water column. Thus it permits this assembly to be maintained at a sufficient depth or sufficiently low altitude relative to the sea bed for the AUV to be able to acquire sonar images of the sea bed, the stabilization means acting as a depressor. It further enables it to be ensured that the receiving antenna for the sonar device installed on board the AUV is able to receive a reflected signal from the transmitting antenna by monitoring (i.e., positioning, varying, or maintaining) its roll, i.e. by stabilizing its list. It enables its immersion to be monitored (i.e., positioned, varied, or maintained) so that it is at a constant depth relative to the sea bed, the relief thereof being variable, which is a prerequisite in order to acquire quality sonar images. This is implemented, for example, by automatically monitoring (i.e., positioning, varying, or maintaining) the immersion of the assembly relative to the altitude of the sea bed. It should be mentioned that the fins of the AUV are not designed to carry out this monitoring (i.e., positioning, varying, or maintaining). The fins of the AUV are not designed to overcome the force exerted upwardly by the traction cable when the AUV is towed. They are solely designed to monitor (i.e., position, vary, or maintain) the depth of the AUV when said AUV is self-propelled.

The system according to the invention thus permits the mission of the AUV to be as efficient as possible, since the AUV is able to acquire sonar images in areas which it would not be able to reach when towed by a ship and also when towed by the ship once its batteries were discharged. Moreover, as the AUV is able to acquire images of an area when towed by the ship, this makes it possible to acquire these images more rapidly than if the AUV were self-propelled.

The stabilization means for the immersion of the receiving device enable the establishment of the connection to be facilitated between the AUV and the receiving device, in particular when the sea is rough, since they permit this operation to be carried out below the surface of the water at a depth which is less affected by the state of the sea. These means also enable the recovery of the AUV to be facilitated by means of a ramp.

Advantageously, the receiving device further comprises a plate which is arranged so that the plate extends below the underside of the AUV when the nose of the AUV bears against the stop, the blocking means also permitting the AUV to be fixed to the plate.

This system has the advantage of limiting the risk of damage to the AUV during the phase of loading onto the ship. It enables no contact to be made between the AUV and the ship during this operation and to provides protection to the AUV (to the body of the vehicle and the equipment protruding from this body). More specifically, once the AUV has been fixed to the stop (and thus the plate) when the connection is pulled from the ship to bring the receiving device toward the ship, the assembly slides onto the ship or onto an inclined plane fixed to the ship. The plate forms the interface between the AUV and the ship or the inclined plane and provides a protective surface to equipment protruding from the underside of the underwater vehicle of the type shown in FIGS. 1*a* and 1*b* in cross section and respectively in side view.

As visible in these figures, the AUV has an elongated body having an oblong shape in longitudinal section (FIG. 1*b*) and a rounded shape in cross section (FIG. 1*a*). This elongated body is provided with external equipment 3 extending below the sides 4*a*, 4*b* of the AUV on the front part thereof (at a reference point associated with the AUV). In other words, the equipment protrudes from the body 2 of the AUV 1 on the sides in the lower part of the body 2 at a reference point associated with the AUV. This equipment comprises, for example, an active sonar device. The equipment is not protected by the hull defining the body 2 of the AUV 1 and as a result is very sensitive to friction and to impacts which may damage it physically and in terms of performance, which leads to errors in subsequent measurements carried out by this equipment.

With the protection provided by the plate, the underwater vehicle and its equipment are not subjected to friction during the phase of loading on board. Moreover, the system according to the invention makes it possible to set a constant incline of the underwater vehicle relative to the plate about the axis of the underwater vehicle which avoids impacts and friction of the equipment protruding from the body of the AUV with the plate but also with the ship. This feature is particularly important during the phase of loading on board. During this phase, when the cable is wound up, if the AUV had not been fixed to a plate forming the interface between the underwater vehicle and the ship, it would be set in motion with rolling movements which could cause impacts and friction between the protruding equipment and the ship. The plate also provides protection to the AUV when the assembly formed by the AUV and the receiving device is set in motion with pitching, heaving and surging movements, relative to the ship during the phase of loading on board.

Advantageously, the plate is fixed to the stop.

Advantageously, the plate has an elongated shape along an axis called the longitudinal axis of the plate between the stop and a so-called free end of the plate, the stabilization means permitting the trim of the plate to be varied between an intercepting position in which the depth of the plate increases from the stop as far as its free end and a receiving position in which the plate extends substantially at the same depth over its entire length.

Advantageously, the receiving device comprises first guide means permitting the nose of the underwater vehicle to be guided toward the stop when said underwater vehicle and the stop approach one another.

Advantageously the system comprises second guide means permitting a longitudinal axis of the underwater vehicle to be aligned with the longitudinal axis of the plate when the underwater vehicle comes to bear against the stop and rests on the plate.

Advantageously, the system comprises first sliding means permitting the friction to be limited between the first guide means and the underwater vehicle and/or second sliding means permitting the friction to be limited between the second guide means and the underwater vehicle.

Advantageously, the system comprises first shock absorbing means permitting an impact to be dampened between the nose of the underwater vehicle and the first guide means and/or second shock absorbing means permitting an impact to be dampened between the underwater vehicle and the second guide means.

Advantageously, the system comprises a ramp designed to ensure the interface between the deck of the ship and the marine environment, and the receiving device being capable of sliding on the ramp, the system comprising third guide means, the function thereof being to ensure an alignment of a longitudinal axis of the receiving device with the ramp when said receiving device slides on the ramp, the ramp comprising first bearing means, second bearing means of the receiving device bearing thereagainst when said device is guided by the guide means so as to set a constant incline of the receiving device relative to the ramp about the longitudinal axis of the plate.

Advantageously, the receiving device comprises power connection means, automatically providing the connection of the battery of the underwater vehicle to a device for recharging this battery loaded on board the ship, when the underwater vehicle is fixed to the stop.

Advantageously, the stabilization means are configured so as to permit the offset of the assembly formed by the receiving device and the underwater vehicle to be monitored (i.e., positioned, varied, or maintained) when said vehicle is fixed to the stop.

The invention further relates to an underwater assembly comprising the system according to the invention, the plate being arranged so as to extend over the entire length of a lateral sonar device protruding from the body of the underwater vehicle.

The subject of the invention is also a method for recovering an autonomous underwater vehicle by means of a system according to the invention, comprising:

a step of fixing the underwater vehicle to the stop, a step of monitoring (i.e., positioning, varying, or maintaining) the attitude and the depth of the assembly formed by the underwater vehicle fixed to the stop and the receiving device.

Advantageously, the method comprises, prior to the fixing step, a step of positioning the receiving device in the intercepting position by means of the stabilization means and a step consisting in bringing the plate into the receiving position once the underwater vehicle bears against the stop or when the nose of the underwater vehicle is located at a distance from the stop which is less than a predetermined threshold.

Advantageously, the method comprises:

a step of monitoring (i.e., positioning, varying, or maintaining) the position and attitude of the underwater vehicle so that it travels at a predetermined depth at substantially zero trim and so as to follow a constant course at a constant speed, a step of monitoring (i.e., positioning, varying, or maintaining) the immersion of the receiving device and possibly the lateral offset of the receiving device so as to position said receiving device in alignment with the underwater vehicle a step of monitoring (i.e., positioning, varying, or maintaining) the speed and the route of the ship and/or a step of monitoring (i.e., positioning, varying, or maintaining) the length of the unwound connection so that the underwater vehicle approaches the stop and the route of the underwater vehicle is substantially the same as the route of the ship.

BRIEF DESCRIPTION OF THE DRAWINGS

Further features and advantages of the invention will appear from reading the detailed description which follows made by way of non-limiting example and with reference to the accompanying drawings, in which.

DETAILED DESCRIPTION

Figure 1A:
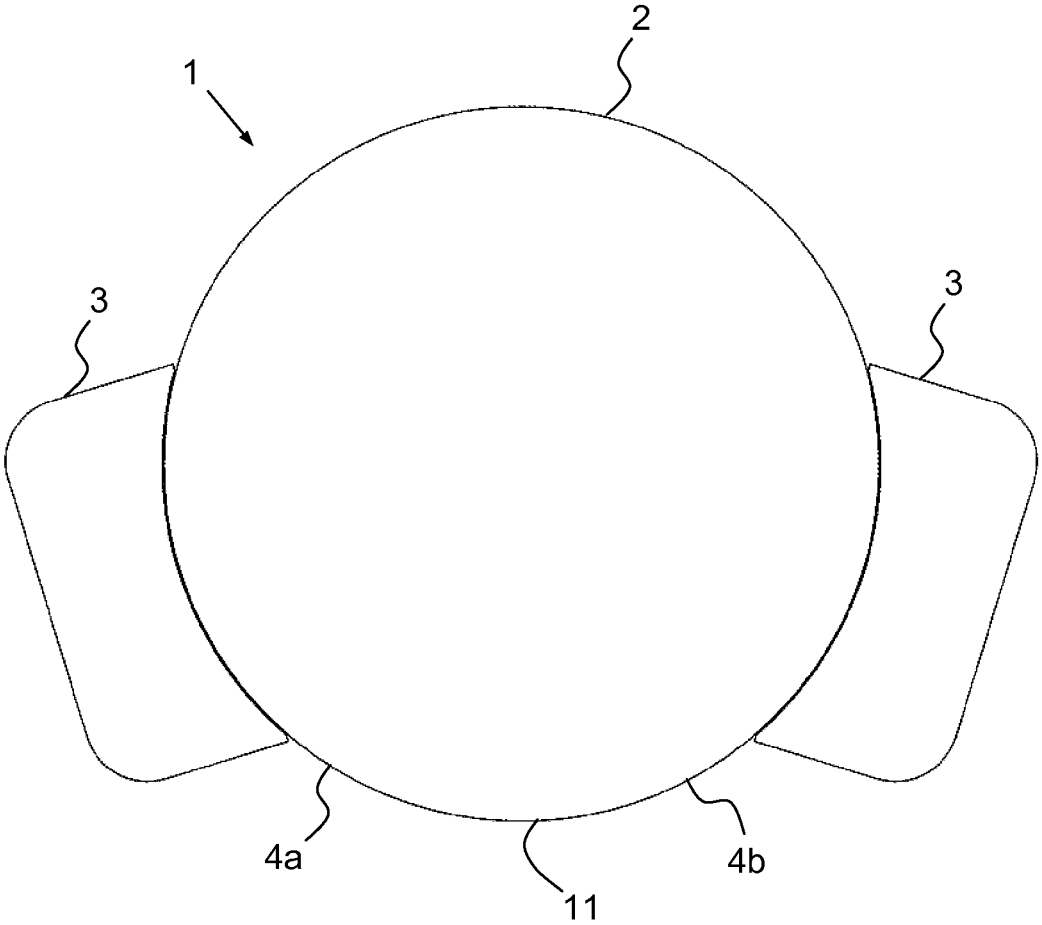
FIGS. 1*a* and 1*b* already described show schematically an example of an autonomous underwater vehicle in cross section (FIG. 1*a*) and in side view (FIG. 1*b*)

From one figure to the next, the same elements are referenced by the same reference numerals.

In the description, the longitudinal axis of a structure advantageously passes via its vertical plane of symmetry.

Figure 2:
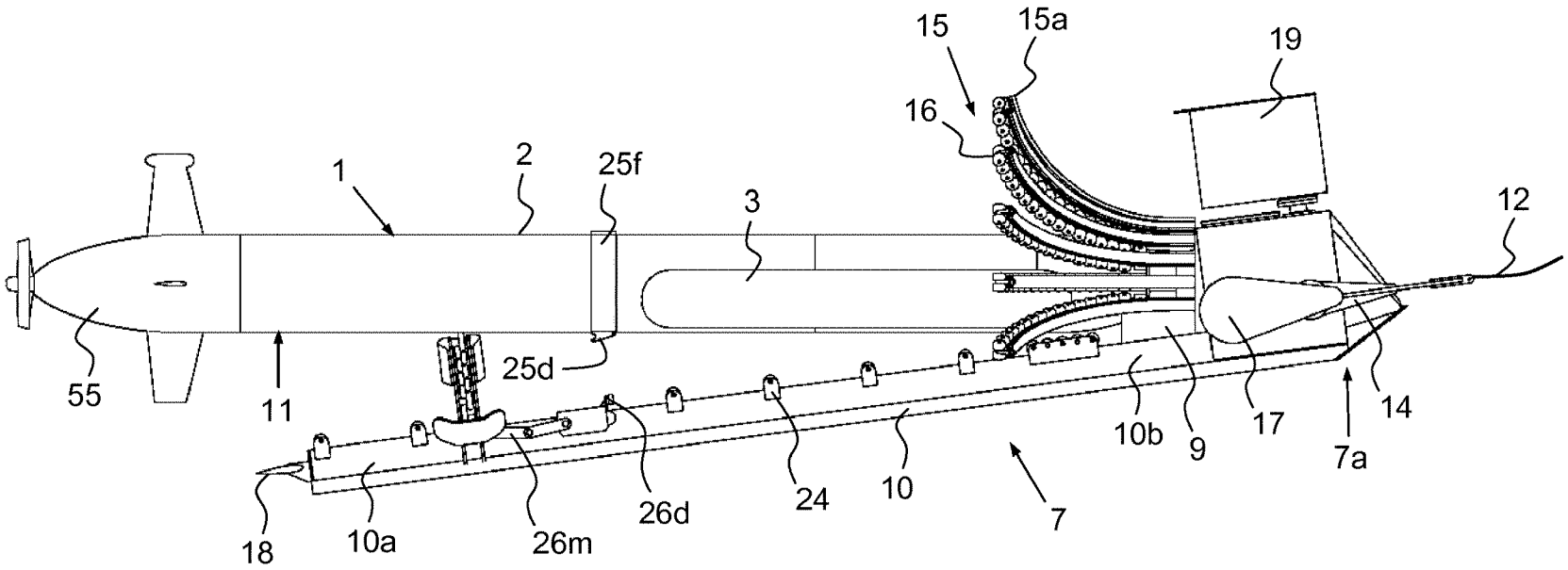
FIG. 2 shows a side view of the receiving device of the system according to the invention in a situation in which the underwater vehicle bears against the stop and the receiving means are in the intercepting position.

Shown schematically in FIG. 2 in side view is a receiving device 7 of a recovery system for recovering an autonomous underwater vehicle 1 from a ship located on the surface of the water. The ship is not shown in FIG. 2.

"Autonomous underwater vehicle" (AUV) is understood as a submersible vehicle which is capable of being displaced in three dimensions in the water, which is not physically connected to a ship and which is provided with the capacity for self-propulsion.

Figure 1B:
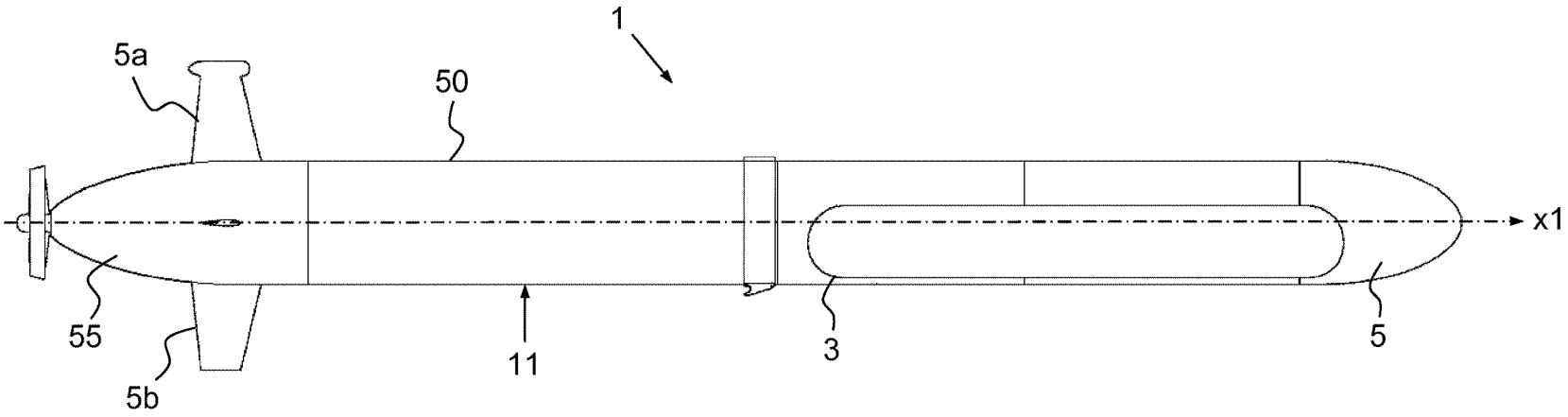

The autonomous underwater vehicle is of the type of that shown in FIGS. 1*a* and 1*b*. It comprises a front part 5 called the nose, visible in FIG. 1*b*, having a generally conical shape. The front of the AUV is defined relative to a reference point associated with the AUV, i.e. along its longitudinal axis x1.

The receiving device 7 is a submersible body. It comprises a stop 9 which is visible in FIG. 4, the nose 5 of the underwater vehicle being capable of bearing thereagainst (as visible in FIG. 2). The stop 9 blocks the movement of the AUV along the longitudinal axis of the AUV 1. The stop 9 advantageously has a shape which closes up in the direction of displacement of the autonomous underwater vehicle when it comes to bear against the stop 9. This shape permits a guidance of the vehicle toward its position in abutment. Moreover, the stop 9 may have a shape which is complementary to that of the nose of the autonomous underwater vehicle.

Figure 3:
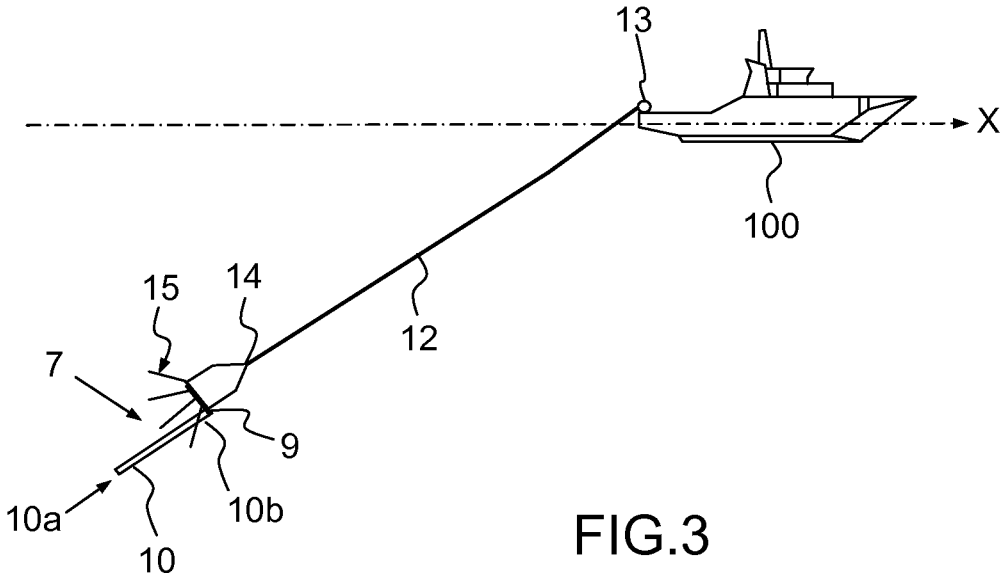
FIG. 3 shows a side view of the system according to the invention.

The recovery system also comprises a flexible connection 12, in this case a cable, providing the interface between the receiving device 7 and the ship 100 (as visible in FIG. 3). In other words, the device 7 is designed to be towed by the ship 100. The flexible connection 12 is thus fixed to the ship. It is advantageously fixed to the rear of the ship 100 along the longitudinal axis of the ship X. The ship 100 may be manned or self-propelled.

The flexible connection 12 is arranged so that the ship pulls the assembly formed by the receiving device and the AUV on the front of the AUV when said AUV is fixed to the stop. In other words, the cable is arranged so that the tractive force exerted by the ship on the AUV, when it tows the AUV, is exerted on the front of the AUV.

To this end, the cable 12 is fixed to the receiving device 7 on the front of the AUV when said AUV bears against the stop 9 at a reference point associated with the AUV. For example in FIG. 2, the fastening 14 by means of which the cable 12 is fixed to the receiving device 7 is fixed to the front of the AUV 1.

In the implementation of the figures (see FIG. 3) the flexible connection 12 is fixed to the receiving device 7 in the region of a first longitudinal end 7*a* of the receiving device 7 in the vicinity of the stop 9.

As is visible in FIG. 3, the system comprises traction means 13, or a traction device, making it possible to pull and deploy the cable 12 or to pull the cable to hoist the receiving device 7 on board the ship 100 or to launch it into the sea. These means are, for example, winding/unwinding means 13, for example a winch permitting the flexible connection 12 to be wound up and unwound from the ship 100.

The receiving device 7 also comprises blocking means, or blocking elements, permitting the AUV to be fixed to the stop 9. These means are described in more detail below. These means permit, in particular, the physical connection to be established between the AUV and the ship which enables the AUV to be brought on board the ship with the receiving device 7.

The receiving device 7 according to the invention comprises stabilization means, or stabilizers, permitting the depth to be monitored (i.e., positioned, varied, or maintained), i.e. the immersion and the attitude, in particular the list and the trim, of the assembly formed by the receiving device and the AUV when said AUV is fixed to the stop 9. By monitoring the depth, trim and list of the assembly, this is understood as varying or maintaining these fixed variables or positioning the assembly at this depth with this trim and with this list.

These stabilization means and the arrangement of the flexible connection permit the AUV to continue its mission of obtaining good quality sonar images of the sea bed by means of an on-board sonar device 3, visible in FIGS. 1*a* and 1*b*, even if it is towed by a ship which advances in the water.

The fact that the stabilization means permit the attitude and the depth of the assembly to be monitored (i.e., positioned, varied, or maintained) implies that they also permit this monitoring (i.e., positioning, varying, or maintaining) for the receiving device itself. This makes it possible to ensure an accurate positioning and orientation of the receiving device when approached by the AUV.

In the implementation of the figures, the stabilization means comprise two pairs 17, 18 of elevators. This embodiment is not limiting, as the stabilization means could, for example, comprise ballast or thrusters or any other means for stabilizing the attitude and the depth of a submersible body.

In this embodiment, each pair of elevators is installed at one longitudinal end 7*a*, 10*a* of the receiving device.

In the implementation of the figures, one of the pairs of elevators 17 is located in the region of the end of the receiving device, the flexible connection 12 being fixed thereto (here the front end 7*a*). This permits the depth of the receiving device 7 to be varied by means of this pair of fins without varying the trim when the device 7 is pulled by the ship 100 by means of the flexible connection 12.

Advantageously, the stabilization means also permit the lateral offset (yaw) of the assembly consisting of the AUV and the receiving device to be monitored (i.e., positioned, varied, or maintained). This permits the quality of the sonar images to be improved when the AUV is towed and also the precision of the positioning of the receiving device to be improved in the phase of the approach of the AUV.

To this end, the stabilization means comprise a rudder 19. This rudder is advantageously arranged in the region of the same end 7*a* as the end to which the flexible connection is attached. This permits a lateral offset to be transmitted to the assembly (or just the receiving device) without transmitting a yaw movement when the device is pulled to the ship by means of the flexible connection.

The receiving device 7 advantageously comprises a plate 10. As visible in FIG. 2, the stop 9 and the plate 10 are arranged so that the plate 10 extends below the underside 11 of the AUV when the nose 5 thereof bears against said stop 9. The underside 11 constitutes the lowest part of the body 2 of the AUV 1 at a reference point associated with the AUV 1. It refers to the lowest part of the cylindrical part 50 of the body 2 located between the front 5 and rear 55 parts of generally conical shape. In other words, at a reference point associated with the receiving device 7, the plate 10 extends below the stop 9.

The plate 10 permits the interface to be ensured between the underwater vehicle 1 and the ship 100 or between the underwater vehicle and a ramp connected to the ship 100 (visible in FIG. 3) during the phase of loading on board and thus reduces the risks of damage to the underwater vehicle during this phase.

The plate has an elongated shape along the second longitudinal axis x2, also corresponding to the axis of the receiving device 7. The elevators 17, 18 are installed in the vicinity of each of the longitudinal ends 10*a*, 10*b* of the plate. In this manner, they are also installed in the vicinity of each of the ends of the AUV when said AUV bears against the stop and rests on the plate.

Advantageously, the plate extends along the entire length of the lateral sonar devices arranged on the sides of the underwater vehicle. This permits their protection to be guaranteed during the phase of loading on board. In other words, the plate is arranged so as to extend over the entire length of a lateral sonar device protruding from the body of the underwater vehicle.

The plate 10 extends longitudinally between a first free end 10*a* and a second end 10*b* of the plate connected to the stop 9 and located in the vicinity of the first end 7*a* of the receiving device 7. The end 10*a* constitutes the second longitudinal end of the receiving device.

In FIG. 2, the receiving device is held in a position in which the plate occupies a position called the intercepting position in which the free end 10*a* of the plate is at a greater depth, relative to the surface of the water, than the end of the plate connected to the stop 9. In other words, the depth of the plate 10 increases from the stop 9 to the free end 10*a* thereof. In other words, in this position the axis of the plate x2 is inclined relative to a horizontal plane so that the free end 10*a* of the plate is at a greater depth than the stop 9.

Figure 7:
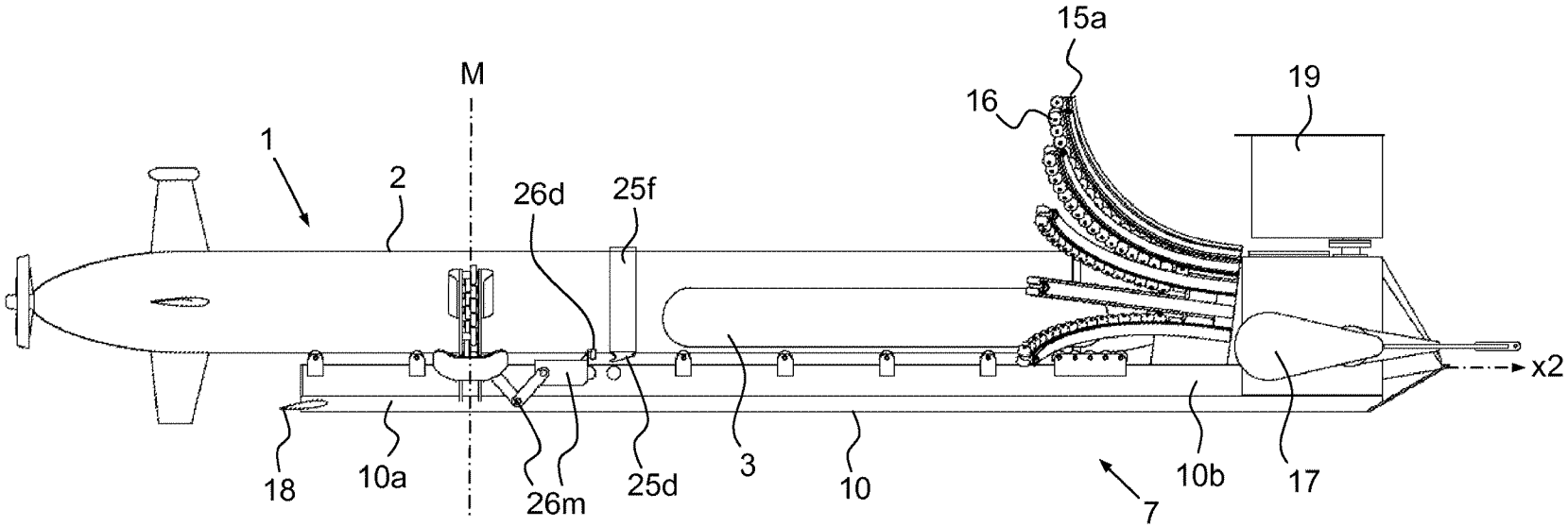
FIG. 7 shows schematically in a view from the side the receiving device of the system according to the invention in a situation in which the underwater vehicle bears against the stop, the receiving means being in the receiving position and the locking means being in the locking position.
Figure 8A:
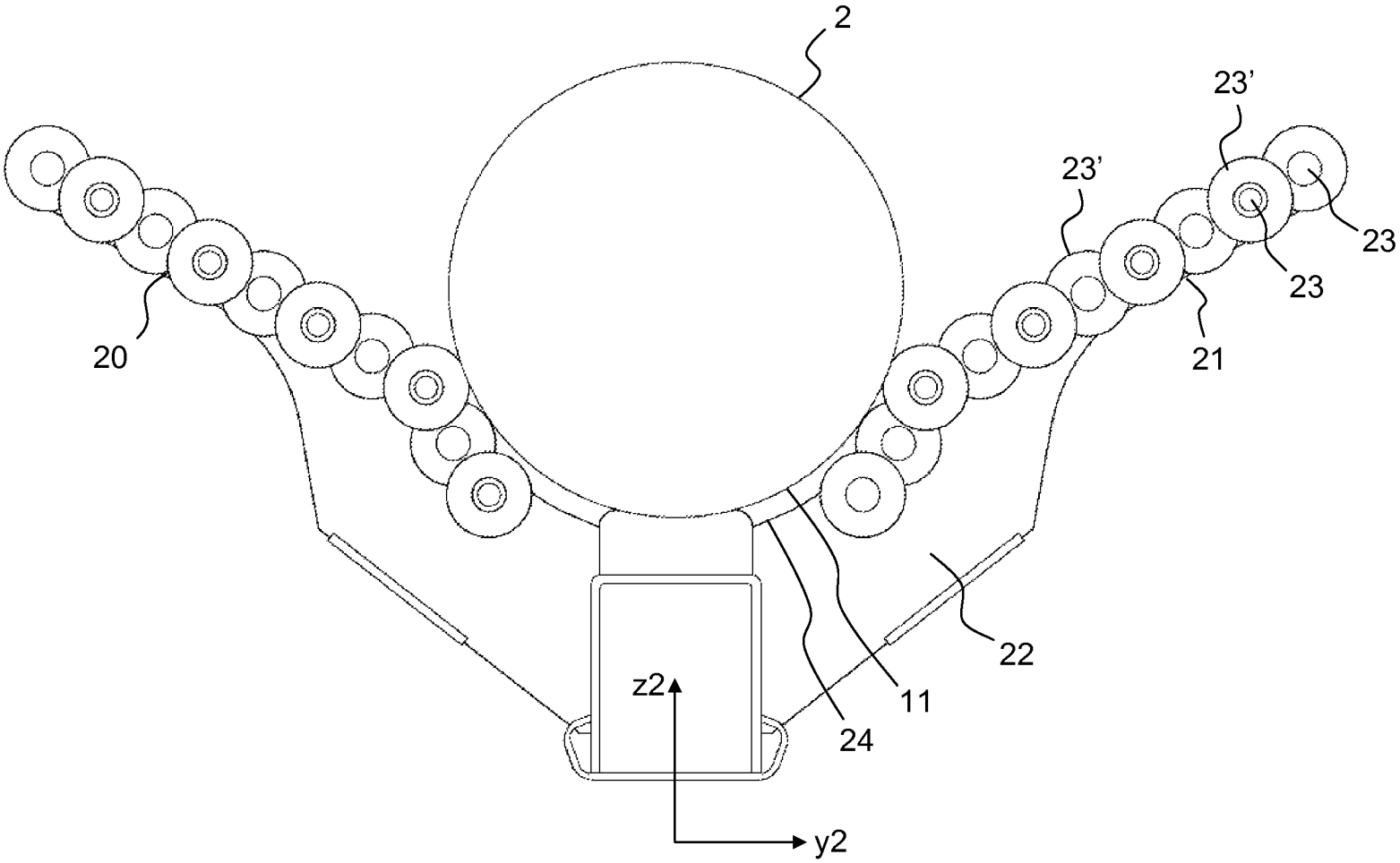
FIG. 8*a* shows a cross section along the plane M of the situation of FIG. 7.
Figure 8B:
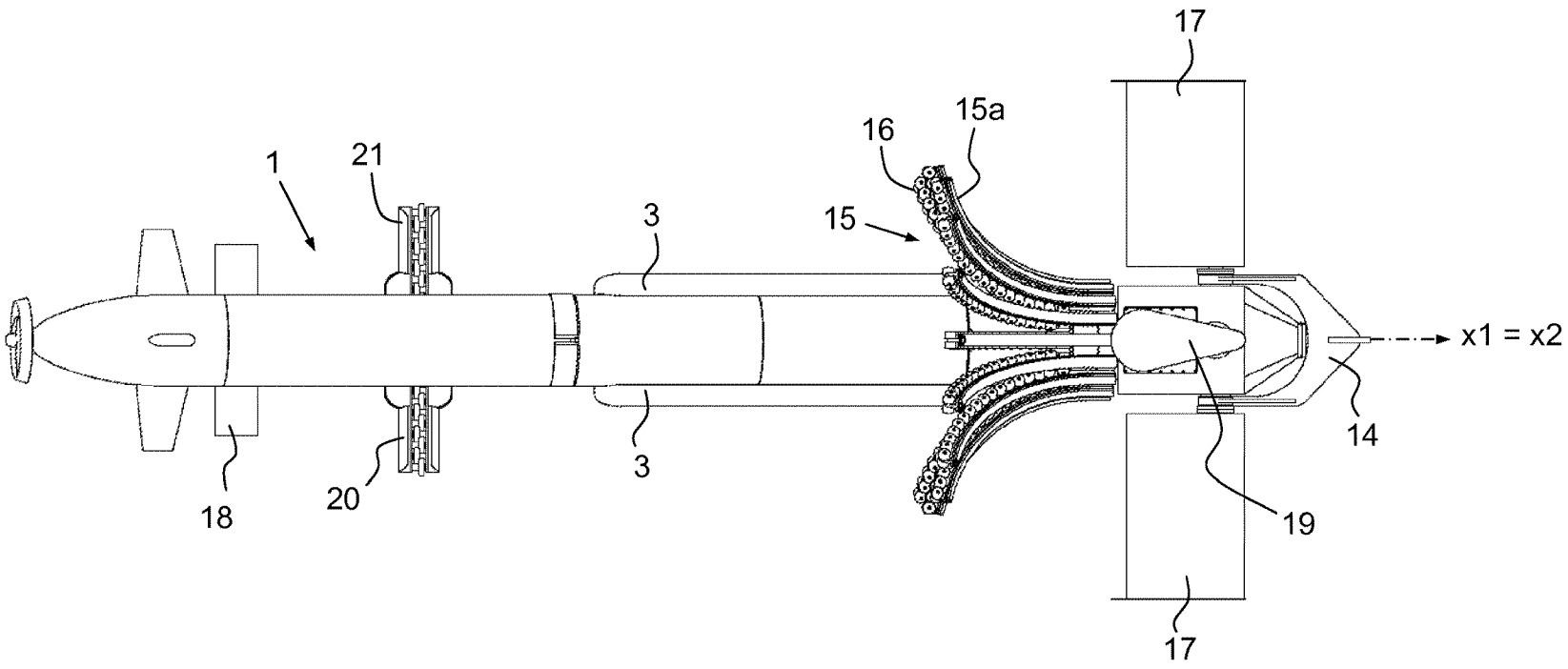
FIG. 8*b* shows a plan view of the receiving device in which the underwater vehicle bears against the stop, rests on the plate and is in its stable position of equilibrium.

Advantageously, the stabilization means permit the trim of the plate 10 to be varied from the intercepting position to a receiving position in which the free end 10*a* of the plate extends substantially at the same depth as its end 10*b* connected to the stop 9 (see FIGS. 7 and 8*b*). Moreover, as the stabilization means permit the trim of the plate to be monitored (i.e., positioned, varied, or maintained), they permit the plate to be maintained in the receiving position and in the intercepting position.

In the intercepting and receiving positions, the plate has zero list or substantially zero list.

In the implementation of the figures, the plate 10 is fixed to the stop 9. The stabilization means thus vary the trim of the receiving device 7 between the intercepting and receiving positions when they vary the trim of the plate 10.

As a variant, the plate 10 is pivotably mounted relative to the stop along an axis perpendicular to the axis of the plate. The stabilization means are thus capable of displacing the plate relative to the stop between the intercepting position and the receiving position. The system thus comprises blocking means permitting the plate and the stop to be fixed in these two positions or at least when it is in the receiving position. The blocking means, which will be described below, thus permit the AUV to be fixed to the stop and the plate when said plate is in the receiving position. Advantageously, the plate is pivotably mounted relative to the stop, solely about said axis perpendicular to the axis of the plate.

The first solution is easier to implement and the second solution does not involve the movement of the stop when the plate moves (the stabilization means maintain the attitude of the fixed stop).

The mobility of the plate 10 between the intercepting and receiving positions permits the risk of damage of the AUV 1 and protruding elements 3 to be limited when the AUV comes to bear against the stop 9, by permitting the plate 10 to be moved out of the space in which the AUV enters to advance toward the stop 9. The risks of friction and impact to which the AUV 1 or its protruding equipment is subjected when establishing the connection between the AUV and the receiving device, i.e. with the ship, are reduced.

Advantageously, as shown in FIGS. 2 to 5, the receiving device 7 comprises first guide means 15, or a first guide, permitting the nose 5 of the underwater vehicle 1 to be guided to the stop 9 when it approaches the stop 9 or when it is approached by the stop 9. Said guide means consist of a mechanical structure arranged about the stop 9 defining a space 151 which is capable of housing the nose 5 of the underwater vehicle 1 and potentially protruding elements 3 on this nose. According to the invention, the space 151 is flared when moving away from the stop 9 along the second axis x2. In the implementation of the figures, these first guide means 15 comprise a plurality of first rigid or flexible branches 15*a* arranged on the periphery of the stop 9 in addition to the plate 10. In other words, the first guide means 15 comprise a plurality of first branches 15*a*, each having a first fixed end on the periphery of the stop 9 and a second free end. These first branches 15*a* delimit with the plate 10 a volume which flares from the stop toward the free end of the branches. As a variant, the guide means are produced in the form of a structure having a funnel shape.

The first guide means 15 make it possible to ensure that the nose 5 of the underwater vehicle 1 comes to bear against the stop 9 even if it does not arrive exactly opposite the stop. When the nose 5 enters the volume 151, it is held there by the guide means 15 which guide its nose 5 toward the stop 9.

Figure 5:
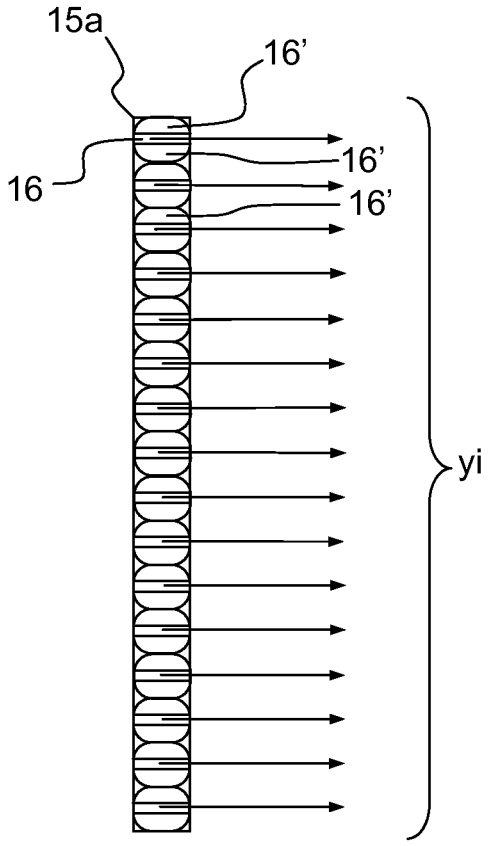
FIG. 5 shows schematically a partial front view of a first branch of the first guide means.
Figure 4:
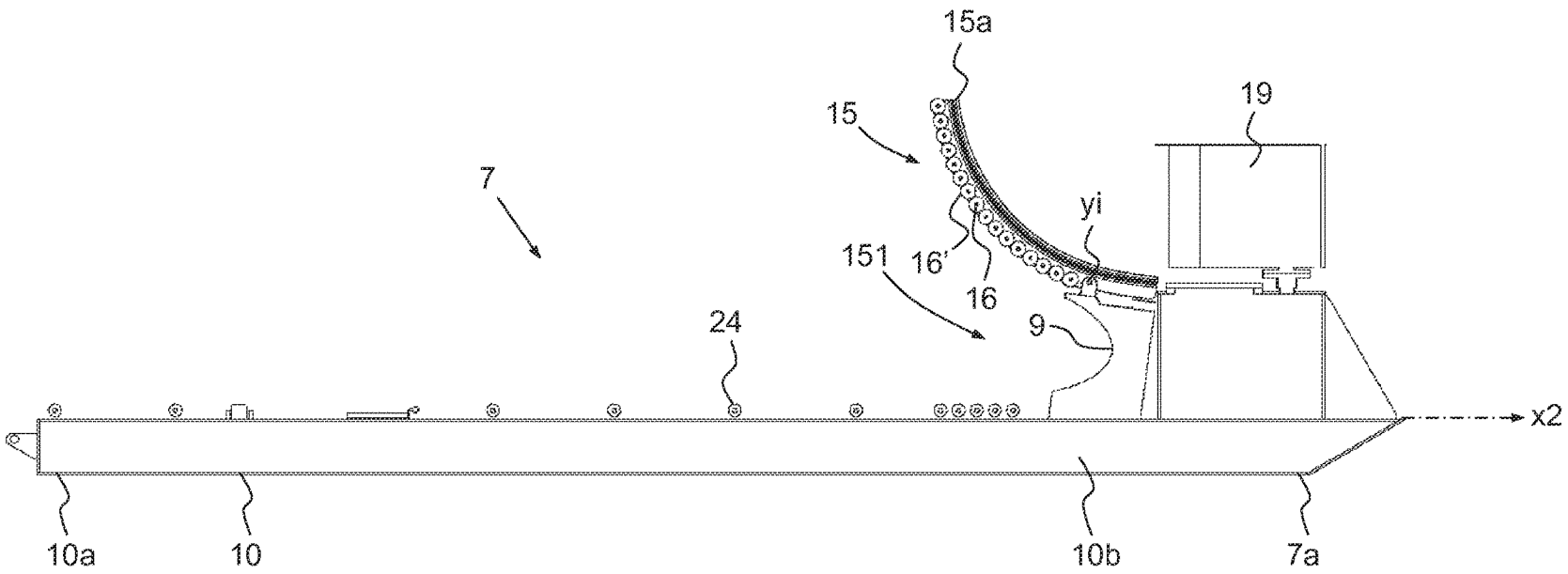
FIG. 4 shows schematically a longitudinal section of the receiving device of the system according to the invention.

Advantageously, as visible in FIG. 4 and in FIG. 5 (showing a first branch 15*a* in a front view) the receiving device 7 comprises first sliding means 16, or first sliding elements, permitting the friction to be limited between the nose 5 of the AUV 1 and the guide means. The first sliding means comprise in this case series of first guide rollers 16 arranged on the branches 15*a*. The first guide rollers 16 installed on a common first branch 15*a* are pivotably mounted on said branch about respective axes yi shown by the arrows in FIG. 5, perpendicular to the branch 15*a*. The guide rollers 16 are installed on the faces of the first branches 15*a* which are located inside the volume 151. They have a generally cylindrical shape.

Thus, when approaching the stop, the nose 5 of the underwater vehicle 1 strikes a guide roller 16 of a first branch 15*a*, and the guide roller pivots about its axis yi which brings the nose 5 toward the stop 9. Thus friction is avoided between the underwater vehicle 1 and the branches 15*a*.

Advantageously, the receiving device 7 comprises first shock absorbing means, or first dampers, permitting an impact to be dampened between the underwater vehicle and the first guide means 15.

These first shock absorbing means comprise, for example, a damping contact surface 16' which is visible in FIG. 5, said guide rollers 16 being provided therewith so as to provide the underwater vehicle 1 with a damping contact surface. The guide rollers 16 comprise, for example, a rigid axle fixed to a branch 15*a*. The rigid axle 16 is surrounded by a resilient material, for example of the foam type, forming the first shock absorbing means 16'.

The first shock absorbing and sliding means protect the nose of the vehicle and possible external equipment which protrude from said nose, as is the case in FIG. 2, by damping impacts and limiting the friction between the first guide means and these elements.

Advantageously, as visible in FIG. 4, the rods 15*a* are pivotably mounted on the stop 9 about axes yi perpendicular to the axis of the plate x2. In this manner, when the AUV strikes the rods, they pivot so as to dampen the impact.

Advantageously, the rods 15*a* are rigid. In this manner, the rods resist drag due to the flow of water whilst damping the impacts with the nose of the AUV.

Figure 6:
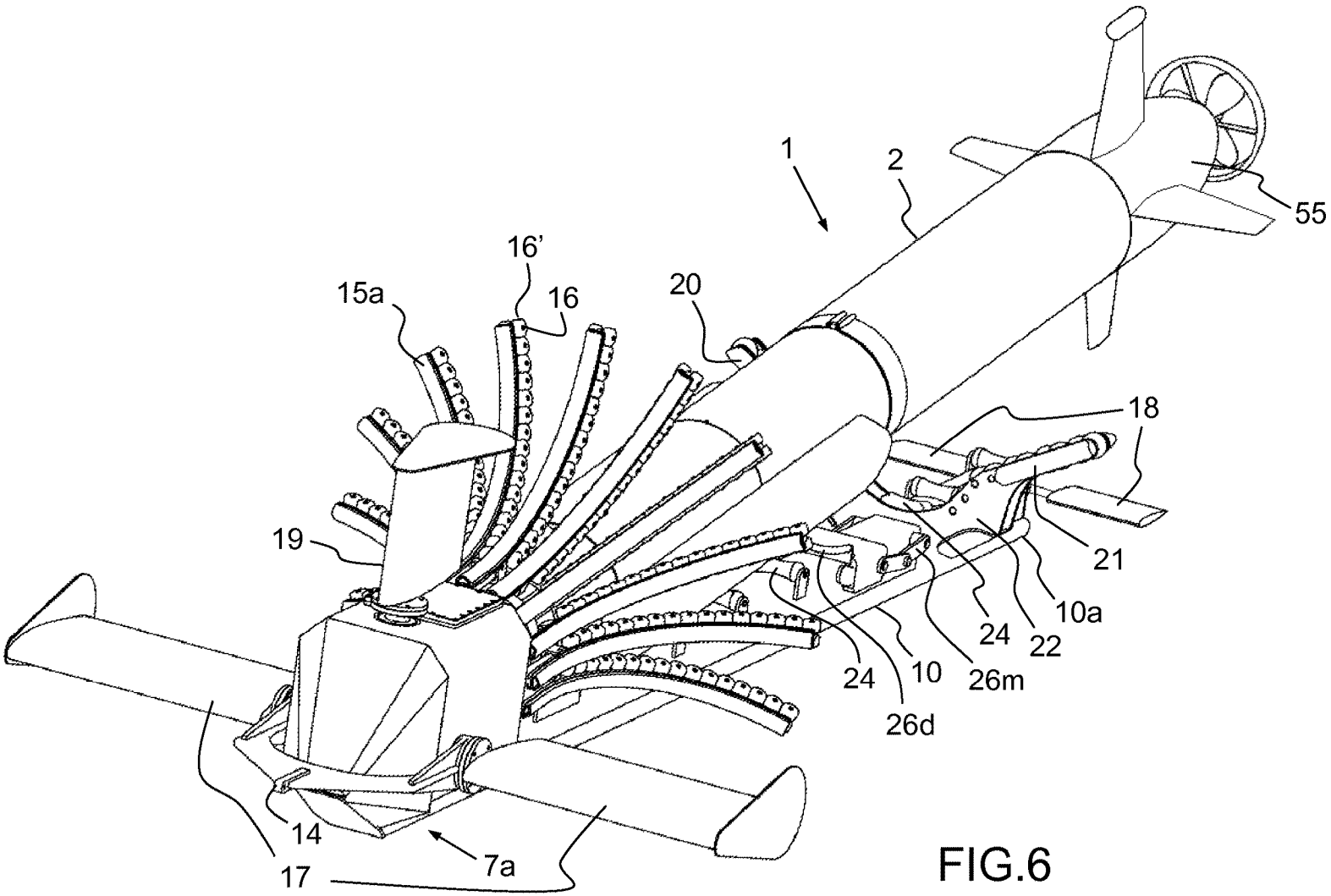
FIG. 6 shows a perspective view of the situation shown in FIG. 2.

As visible in FIGS. 6, 8*a* and 8*b*, the receiving device 7 also comprises second guide means 20, 21, 22, or a second guide, permitting the longitudinal axis x1 of the underwater vehicle 1 to be aligned with that of the plate 10 (as visible in FIG. 9*b*).

These second guide means 20, 21, 22 are arranged so as to align the axis of the AUV x1 with that of the plate x2 when the AUV comes to bear against the stop 9 and comes to rest on the plate 10, for example, when the receiving device 7 is brought from its intercepting position to its receiving position when the underwater vehicle 1 bears against the stop 9.

As visible in FIGS. 6, 8*a* and 8*b*, the second guide means comprise a mechanical structure 20, 21, 22 on which the underwater vehicle may slide and which is arranged so as to guide the underwater vehicle to a position of stable equilibrium when the plate 10 is brought from its intercepting position into its receiving position. This structure is also arranged so as to guide the AUV which arrives on the stop when its longitudinal axis is not aligned with that of the plate, when it is in the receiving position as visible in FIG. 7.

It should be mentioned that the receiving device is arranged so that when the AUV bears against the stop 9 (at zero trim) and the receiving device is in the receiving position, the underwater vehicle 1 rests on the plate 10.

The mechanical structure 20, 21, 22 is arranged so that in the stable position of equilibrium (as visible in FIGS. 8*a* and 8*b*) the longitudinal axis x1 of the underwater vehicle is aligned with the longitudinal plate axis x2.

In the implementation of FIG. 6, the mechanical structure comprises two second branches 20, 21 fixed rigidly to the plate and a connection 22 connecting the second branches 20, 21 to the plate, the vehicle being capable of sliding thereon. The second branches 20, 21 extend in a plane perpendicular to the axis of the plate 10 and are arranged on either side of the plate symmetrically and inclined relative to a vertical plane passing through the axis of the plate x. They are connected by a connection which forms an enclosure having a shape which is complementary to the underside 11 of the body 2 of the AUV 1.

In this manner, when the AUV 1 bears against the stop 9 and the plate is moved from its intercepting position to the receiving position, if the longitudinal axes of the plate and of the AUV are located in vertical non-parallel planes, the AUV slides on the second guide means which brings these axes into the parallel vertical planes.

When the plate reaches the receiving position, the AUV rests thereon and their longitudinal axes are located in parallel horizontal planes.

The longitudinal axes of the plate and the AUV will thus be aligned, i.e. located in vertical and parallel longitudinal planes. As visible in FIG. 9, the device is arranged so that these axes are located in a common vertical plane.

Moreover, the receiving device and the second guide means 20, 21, 22 are arranged so that, when the underwater vehicle 1 bears against the stop 9, the plate extends along its entire length on either side of the underside of the underwater vehicle 1. In other words, the plate extends below the underside and the sides of the AUV.

Advantageously, the receiving device 7 comprises second sliding means (or second slide elements) permitting the friction to be limited between the second guide means 20, 21, 22 and/or second shock absorbing means permitting an impact to be dampened between the second guide means and the underwater vehicle 1.

As visible in FIG. 8*a*, the second branches 20, 21 are provided with second guide rollers 23. The second guide rollers 23 fixed to a branch are mobile in rotation relative to this branch about respective axes perpendicular to the axis of the branch and parallel to the axis x of the plate 10. The guide rollers 23 are installed on the faces of the branches 20, 21 which face the underwater vehicle when it bears against the stop 9.

The second sliding means permit, by limiting the friction, to maintain the list of the underwater vehicle at a constant level when the receiving device passes from the intercepting position to the receiving position.

Advantageously, the second shock absorbing means, or second dampers, comprise damping contact surfaces 23' with which the second guide rollers 23 are provided, and which are produced so as to provide the underwater vehicle 1 with a damping contact surface. The guide rollers 23 are, for example, produced in the form of rigid axles fixed to a second branch 20 or 21 and are provided to be surrounded by a resilient material, for example of the foam type, forming the second shock absorbing means.

The second shock absorbing and sliding means permit the body of the AUV to be protected, by damping impacts and limiting friction between the second guide means and these elements.

Advantageously, the plate comprises third shock absorbing means 24, or third dampers, permitting the physical contact to be dampened between the AUV and the plate 10. In the implementation of the figures, these means comprise cushions 24 produced from resilient material arranged on the surface of the plate and spaced apart along the longitudinal axis of the plate.

Advantageously the blocking means comprise locking means 25*d*, 25*f*, 26*d*, 26*m*, or a locking device, permitting a locking function to be carried out which is consistent with maintaining the AUV in abutment against the stop 9, maintaining the list of the AUV at a constant level relative to the plate (i.e. to set a constant incline of the underwater vehicle relative to the plate about the longitudinal axis of the underwater vehicle) and maintaining the AUV in abutment against the plate 10 (i.e. to prevent movements of the AUV relative to the plate along the axis z2 perpendicular to the plane of the plate and the axis x2).

These means are visible in FIG. 2 and FIG. 6, and they comprise first locking means 25*d*, or a first locking device, fixed to the underwater vehicle 1, and second locking means 26*d*, or a second locking device, incorporated in the receiving device 7. The first and second locking means respectively comprise a first finger 25*d* and a second finger 26*d* capable of cooperating so as to implement the locking function.

The first locking means comprise in this case a first finger 25*d* fixed to the AUV 1. It is, for example, fixed thereto by means of a metal hoop 25*f* encircling the AUV 1. The second locking means comprise a second finger 26*d*. The second finger extends in a circular arc about the axis x2 of the plate and symmetrically relative to this axis. It also extends on either side of the axis of the plate x2. This finger 26*d* is mobile in translation along the axis of the plate x between an unlocked position (visible in FIGS. 2 and 6) in which it is remote from the second finger and a locked position (in which it is the finger in FIGS. 9 and 10 but not visible) in which it bears against the first finger 25*d* perpendicular to the axis of the plate and in which it exerts a tractive force on the first finger parallel to the axis x of the plate and in the direction of the stop 9, when the AUV 1 rests on the plate 10, so as to implement the locking function.

The second locking means also comprise traction means, or a traction device, making it possible to move the finger 26*d* between the unlocked position and the locked position and to maintain said finger in these two positions. The traction means comprise, for example, an articulated arm 26*m* connected to the finger 26*d*. The fact that the finger 26*d* extends in a circular arc permits the AUV to be fixed to the plate and the stop 9 even when it is at non-zero list of an absolute value which is less than or equal to a predetermined angle corresponding to half of the angle on which the finger extends. The angle is, for example, equal to 10°. As a variant, the finger is positioned on the axis x2 and has an angular opening of less than 1°.

The blocking means also comprise means or a device permitting lateral movements to be prevented (along the axis y2 extending perpendicular to the axes x2 and z2 perpendicular thereto) of the underwater vehicle 1 relative to the plate. These means in this case comprise the connection 22 (visible in FIG. 8*a*) which encircles the underside 11 of the underwater vehicle when said vehicle is in the stable position of equilibrium.

As a variant, the first and second locking means are configured so as to implement a first locking function which is consistent with maintaining the AUV in abutment against the stop 9 and maintaining the list of the AUV at a constant level relative to the plate. The locking means thus also comprise means permitting the AUV to be held in abutment against the plate. It refers, for example, to mobile arms between a released position in which they do not exert force on the AUV and a bearing position in which they come to bear against the top of the AUV so as to hold it in abutment against the plate.

Figure 9:
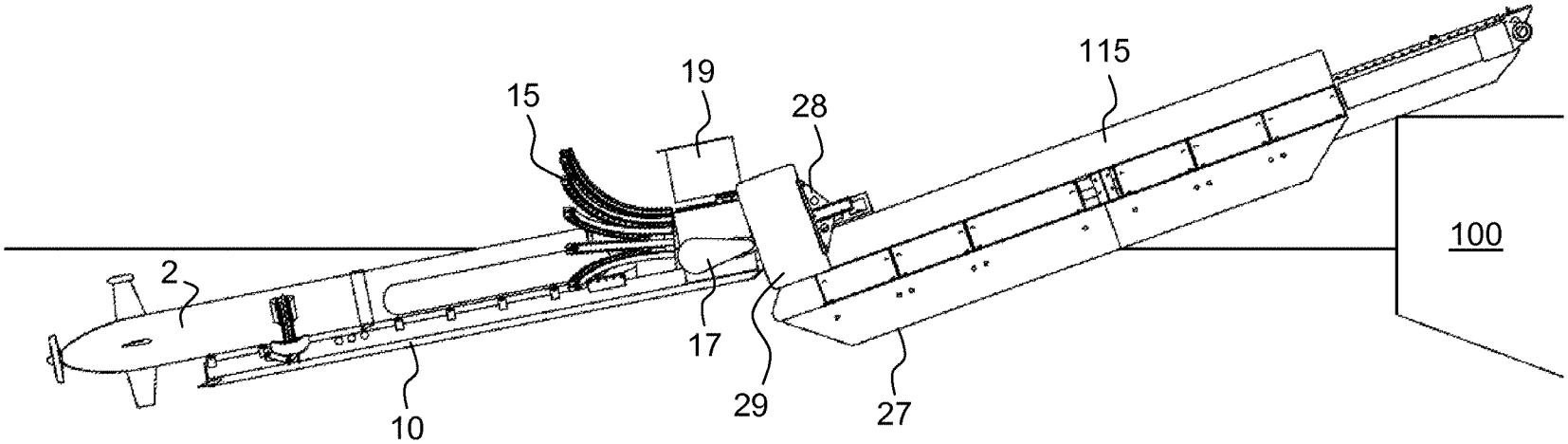
FIGS. 9 and 10 show schematically in a side view the system according to the invention in a towing situation in which the receiving device arrives in the region of the ramp (FIG. 9) and travels up along the ramp (FIG. 10)
Figure 10:
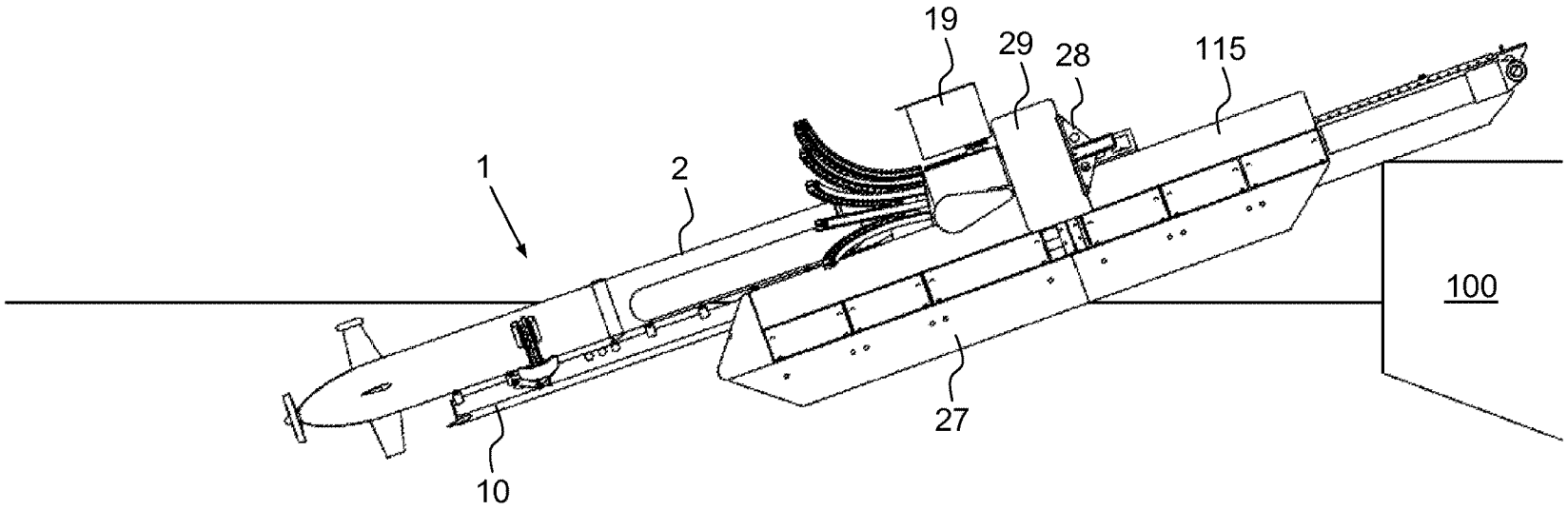

The system according to the invention advantageously but not necessarily comprises a ramp 27 as visible in FIGS. 9 and 10, designed to provide an interface between the deck of the ship 100 and the marine environment, and on which the receiving device 7 is capable of sliding.

This ramp may be fixed relative to the ship, for example of the inclined plane type, or even a ramp pivotably mounted relative to the ship 100 about an axis perpendicular to the longitudinal axis of the ramp.

The ramp advantageously comprises floating means or floaters, not shown, configured and arranged so that an end of the ramp floats on the surface or in the vicinity of the surface of the water shown in thick lines in FIGS. 9 and 10. This feature permits the contact between the ramp and the marine environment to be guaranteed.

The ramp may, for example, be a ramp of the type of that described in the patent application FR1004764 or in the patent application FR1201573.

Figure 11:
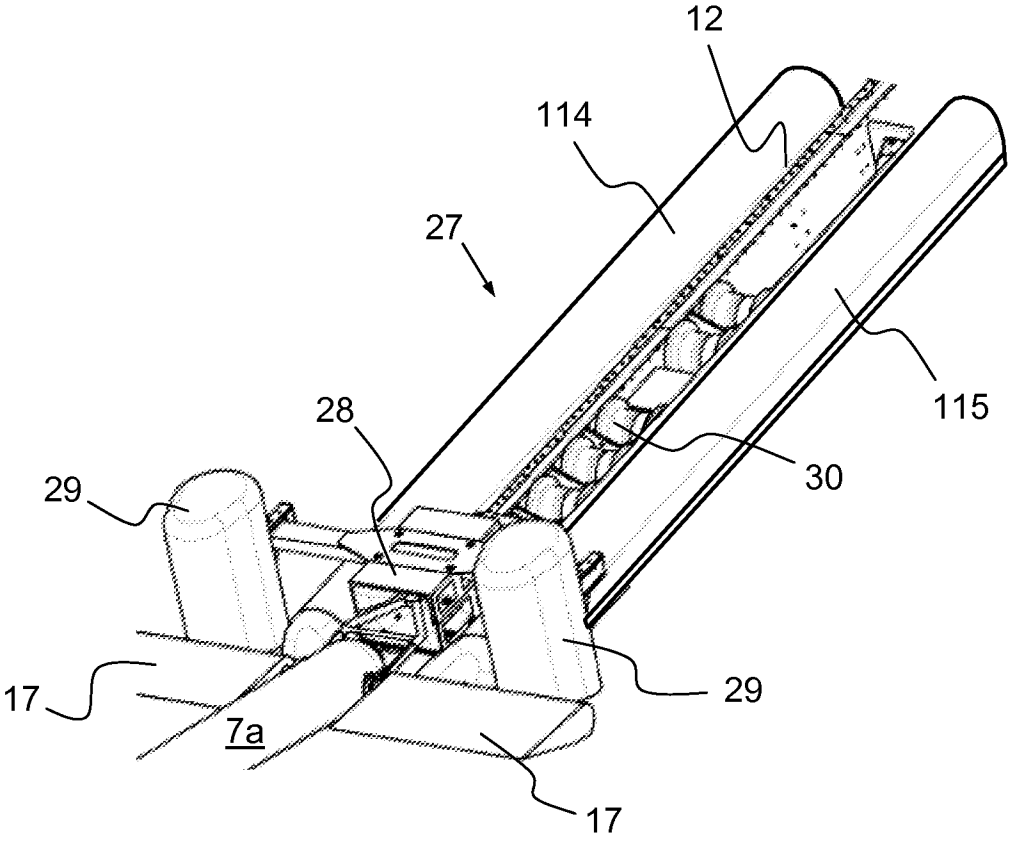
FIG. 11 shows schematically a detail of the ramp in a plan view.

Advantageously the system comprises third guide means 28, or a third guide, the function thereof being to provide an alignment of the longitudinal axis x2 of the receiving device 7 on the longitudinal axis of the ramp so as to permit correct sliding or rolling of the assembly formed by the device 7 and the underwater vehicle 1 along the path thereof on the ramp (upward or downward). These means comprise, for example, as illustrated in FIG. 11, a device used as a fairlead, inside which passes the traction cable 12 of the vehicle configured to move along the ramp 27, for example on a rail arranged along the longitudinal axis thereof (not shown in the figure).

The system comprises means or a device for maintaining the incline, permitting a constant incline to be set on the receiving device relative to the ramp, about the axis of the plate. In other words, these means permit a constant trim to be set on the receiving device. These means comprise, in particular, the first bearing means 29, the elevators 17 used as second bearing means bearing thereagainst when the device is guided by the guide means 28. As a variant, further means are provided to implement the function of second bearing means in place of the fins 17.

The means for maintaining the incline further advantageously comprise longitudinal edges 114, 115 of the ramp (visible in FIG. 11) configured to form longitudinal bearing elements. The thickness of the edges is thus adapted to the dimensions of the receiving device and the AUV under consideration, so that when the assembly is installed on the ramp, the plate rests on the means 30 whilst the second bearing means, for example the fins, rest on the edges 114 and 115 on which they slide.

The ramp advantageously comprises further sliding means 30, also called a further guide, designed to promote the progress of the receiving device along the ramp, under the action of the traction exerted by the cable (recovery) or by gravity (launching). These means are, for example, rollers or guide rollers arranged laterally on the base of the ramp and on which the device rolls.

The system according to the invention comprises power connection means, not shown, also called a connection, providing automatically the connection of the battery of the AUV to a device for recharging this battery installed on board the ship 100 when the AUV is fixed to the stop 9. This feature enables the battery to be recharged on the deck of the ship without human intervention. The transfer of energy is advantageously carried out by the cable 12.

Now the method for recovering the autonomous underwater vehicle will be described according to the invention by means of the recovery system according to the invention.

The method advantageously comprises a step of fixing the AUV to the stop 9 (and advantageously the plate 10 when the AUV rests on the plate 10). The AUV is then transformed into a recovered body.

The method then advantageously comprises a step of monitoring (i.e., positioning, varying, or maintaining) the attitude and the depth of the assembly formed by the receiving device of the AUV fixed to the stop by means of stabilization means. For example, the stabilization means are monitored so as to maintain the assembly at a constant altitude relative to the sea bed. The method further advantageously comprises a step of acquiring sonar images by means of a sonar device installed on board the AUV as long the assembly is in the water. The system advantageously comprises wireless communication means (for example of the wifi or optical type), also called a wireless communication device, permitting the sonar images acquired by the AUV to be transmitted to the ship 100. This refers, for example, to communication means between the flexible connection 12 and the AUV, the cable then transmitting the data to the ship 100.

The method advantageously further comprises a step of recovering the assembly on board the ship 100, during which a tractive force is exerted on the assembly so as to pull it toward the ship 100 and to load it on board the ship 100 by causing it to slide on the ramp. This step is implemented by winding up the cable 12 around the winch and by means of the winch 13.

Prior to establishing the connection between the AUV and the receiving device 7, the method advantageously comprises a step of monitoring (i.e., positioning, varying, or maintaining) the position and the attitude of the AUV so that it travels to a predetermined depth at substantially zero or zero trim, and so as to follow a constant course which is advantageously that of the ship at constant speed.

The depth is selected as a function of the state of the sea. This is even more important if the sea is rough, in order to proceed with the recovery in relatively calm waters.

The method advantageously comprises a step of monitoring (i.e., positioning, varying, or maintaining) the speed of the ship 100 so that it travels at a lower speed than that of the AUV so that the AUV may approach the ship 100. More generally, the device comprises a step of monitoring (i.e., positioning, varying, or maintaining) the route of the ship and/or a step of monitoring (i.e., positioning, varying, or maintaining) the length of the unwound cable (or connection) so that the underwater vehicle approaches the stop and the route of the underwater vehicle is substantially identical to that of the ship.

As the receiving device 7 is towed by the ship and has an elongated shape it is naturally oriented so that its longitudinal axis is located along the axis X of the ship 100 which is parallel to the speed of the AUV.

The method according to the invention advantageously comprises a step for monitoring (i.e., positioning, varying, or maintaining), by means of the stabilization means, the immersion of the receiving device and positioning it at a predetermined depth which is advantageously the depth of the AUV 1.

The method advantageously further comprises a step of monitoring (i.e., positioning, varying, or maintaining) the lateral offset of the receiving device and positioning it in the alignment of the underwater vehicle.

The method possibly comprises a step of monitoring (i.e., positioning, varying, or maintaining) the attitude of the receiving device and orientate said receiving device optimally relative to the AUV to ensure its recovery.

Given that the underwater vehicle 1 has a greater speed than that of the ship, it approaches the device according to the invention until it bears against the stop 9.

The intercepting of the underwater vehicle by the receiving device 7 may be implemented when said device is in the receiving position. The underwater vehicle 1 then comes into contact with the plate and, in particular, with the third shock absorbing means and slides thereon before reaching the stop.

In one preferred embodiment, the method comprises, before the AUV comes to bear against the stop 9, a step of monitoring (i.e., positioning, varying, or maintaining) the attitude of the plate so as to bring it and maintain it in the intercepting position.

The method also comprises a further step of monitoring (i.e., positioning, varying, or maintaining) the attitude, by means of the stabilization means, so as to bring the plate from its intercepting position into its receiving position, when the AUV bears against the stop 9 or when the nose of the AUV is located at a distance from the stop which is less than a predetermined threshold.

To this end, the system according to the invention comprises means for surveillance, or a surveillance device, permitting surveillance of the position of the underwater vehicle relative to the stop 9 and possibly relative to the plate 10.

The means for surveillance advantageously permit the distance of the underwater vehicle to be measured relative to the stop and possibly relative to the plate. They advantageously comprise means permitting the distance of the nose of the underwater vehicle relative to the stop to be determined from the measurement of the position of the underwater vehicle, and means permitting this distance to be compared with the predetermined threshold and possibly its attitude to be determined. These means may comprise optical, acoustic or electromagnetic devices. The AUV comprises, for example, devices for emitting luminous signals, such as for example a lamp, permitting the positioning thereof by the ship equipped with means capable of intercepting and measuring the distance from the AUV to the stop from these signals.

As a variant, the means for surveillance permit the establishing of physical contact between the stop and possibly the plate to be detected. They comprise detecting means or a detector, making it possible to detect when the underwater vehicle 1 bears against the stop 9, and possibly against the plate 10. These means comprise, for example, one or more pressure sensors.

Once the receiving device 7 has reached the receiving position, the underwater vehicle rests on the plate 10. Then the AUV is fixed to the stop 9 and advantageously to the plate 10 by means of the blocking means and, in particular, by means of the locking means.

The fixing step comprises a step of locking by means of the locking means. This step may be carried out by control means, also called the control device, located on the ship. It requires means for the surveillance of the position of the underwater vehicle 1, also called a surveillance device, relative to the stop and the plate. As a variant, this step is carried out automatically, the arrival of the underwater vehicle bearing against the plate automatically triggering the actuation of the locking means.

The stabilization means of the position and the attitude of the AUV and the receiving device, the locking means and the traction means (here the winch 13), may be controlled by control means located on board the ship or from a station on the ground or in the air (for example an aircraft). When the control is able to be implemented from a place other than the ship (ground or air), the system is known as remotely controlled. The control means may be automatic control means or means permitting an operator to control these stabilization means remotely.

In this last case, the system then comprises information means, or an information device, comprising for example, display screens and/or alarm means, permitting the operator to be informed about the output of the means for surveillance. As a variant, the means for surveillance comprise a camera permitting surveillance by the operator of the movement of the underwater vehicle relative to the device.

In the case of automatic control, the control means are automatic control means capable of controlling the stabilization means, the locking means and the traction means. The outputs of the means for surveillance are then transmitted to the automatic control means. This fully automatic solution makes it possible to dispense with the need for an operator and thus makes it possible to limit the risks associated with a rough sea and may be implemented from an unmanned surface vehicle or USV.

When the system is remotely controlled, the risks of injury to the operators are also limited.

The control commands may be transmitted to the stabilization means of the receiving device 7 by a wireless connection (incorporated in the system according to the invention) or by means of the flexible connection 12 (which is then an electric towing cable).

As a variant, the attitude, the depth and the speed of the AUV are controlled by control means installed on board the AUV. These means may have received a recovery command before the start of the mission, indicating the time, the course and the speed, and the immersion to be adopted at that time. As a variant, the system comprises means of communication between the AUV and the ship permitting the ship to send the recovery command to the AUV.

As a variant, the recovery command sent to the AUV is a command to reach a predetermined rendez-vous point. The method thus comprises a step of monitoring (i.e., positioning, varying, or maintaining) the position of the receiving device so that it places the stop 9 in abutment against the AUV by means of the stabilization means.

The device according to the invention is also a device for launching an AUV from a ship. This device has the same advantages during the phases of unloading the AUV and establishing the connection between the AUV and the receiving device as during the phases of loading the AUV on board and establishing the connection.

A further subject of the invention is a method for launching in the sea by means of the system according to the invention comprising:

a step of launching in the sea the assembly formed by the underwater vehicle and the receiving device, the underwater vehicle bearing against the stop and advantageously resting on the plate 10, the blocking means fixing the underwater vehicle to the stop and the plate, this step being advantageously implemented by causing the device to slide along a ramp, advantageously a step of monitoring (i.e., positioning, varying, or maintaining) the position of the device 7 and positioning and maintaining the device at a predetermined depth, by means of the stabilization means, this step is advantageously followed by a step of monitoring (i.e., positioning, varying, or maintaining), during which the stabilization means bring the plate into an intercepting position before the underwater vehicle leaves the stop or before the front end of the nose of the underwater vehicle is located at a distance from the stop which is greater than a predetermined threshold, a step of releasing the underwater vehicle, for example, by controlling the locking means by means of the control means, this step being able to be implemented before or after the preceding step.

These last steps make it possible to reduce the risks of damage to the underwater vehicle when it moves away from the stop.

The subject of the invention is also an underwater assembly comprising the autonomous underwater vehicle and/or the ship, in addition to the recovery system according to the invention.

As visible in FIG. 1*b*, the AUV 1 comprises lower fins or controllers 5*b* extending below the body of the underwater vehicle and upper fins 5*a*, extending above the body at a reference point associated with the underwater vehicle. These fins are located to the rear of the underwater vehicle. The lower fin protrudes below the underside 11 of the underwater vehicle.

Advantageously, as visible in FIGS. 7 and 8, the receiving means are designed so that the plate does not extend as far as below the lower fin 5*b* when the underwater vehicle 1 bears against the stop 9.

Advantageously the ramp and the receiving device are arranged and configured so that when the receiving device 7 fixed to the vehicle 1 slides on the ramp, the lower fin 5*b* does not strike the base of the ramp. In the example of FIG. 11, the ramp has a hollow base. As a variant, the receiving means are configured so that when the vehicle rests on the plate, the lower fin 5*b* does not protrude below the plate. This is carried out by altering the thickness of the plate, for example. As a variant, the underwater vehicle does not comprise a lower diving rudder or comprises cross-shaped diving rudders. These features make it possible not to have to leave the vehicle on the ramp and to be able to lift it completely onto the bridge.

The invention claimed is:

1. A recovery system for recovering an autonomous underwater vehicle from a ship, said underwater vehicle comprising a front part called a nose, said system comprising:

a receiving device comprising a stop, the nose of the underwater vehicle being capable of bearing thereagainst, blocking means making fixing the underwater vehicle to the stop possible, a flexible connection providing an interface between the receiving device and the ship, the flexible connection being arranged such that the ship pulls the receiving device, stabilization means configured to permit positioning the receiving device at a depth and with a trim of the receiving device, and a plate which is arranged so that the plate extends below an underside of the underwater vehicle when the nose of the underwater vehicle bears against said stop, the blocking means being configured to permit fixing the underwater vehicle to the plate.

2. The recovery system as claimed in claim 1, in which the plate is fixed to the stop.

3. The recovery system as claimed in claim 1, in which the plate extends along a longitudinal axis between the stop and a free end of the plate, the stabilization means permitting a trim of the plate to be varied between an intercepting position in which the depth of the plate increases from the stop as far as the free end and a receiving position in which the plate extends substantially at the same depth over an entire length of the plate.

4. The underwater assembly as claimed in claim 1, in which the receiving device comprises first guide means configured to guide the nose of the underwater vehicle toward the stop when said underwater vehicle and the stop approach one another.

5. The recovery system as claimed in claim 1, comprising second guide means configured to align a longitudinal axis of the underwater vehicle with a longitudinal axis of the plate when the underwater vehicle comes to bear against the stop and rests on the plate.

6. The underwater assembly as claimed in claim 4, comprising first sliding means configured to limit friction between the first guide means and the underwater vehicle and/or second sliding means configured to limit friction between a second guide means and the underwater vehicle.

7. The underwater assembly as claimed in claim 4, comprising first shock absorbing means configured to dampen a force generated by an impact between the nose of the underwater vehicle and the first guide means and/or second shock absorbing means configured to dampen a force generated by an impact between the underwater vehicle and the second guide means.

8. The underwater assembly as claimed in claim 1, in which the stabilization means are configured to permit positioning the receiving device at a depth and with trim of the receiving device with a lateral offset, said underwater vehicle being fixed to the stop.

9. A method for recovering an autonomous underwater vehicle by means of an underwater assembly as claimed in claim 1, comprising:

a step of fixing the underwater vehicle to the stop, followed by a step of positioning the underwater vehicle fixed to the stop and the receiving device with the list and the trim and at the depth.

10. The method for recovering as claimed in claim 9, comprising, prior to the fixing step, a step of positioning the receiving device in an intercepting position by the stabilization means and a step of bringing a plate into the receiving position once the underwater vehicle bears against the stop or when the nose of the underwater vehicle is located at a distance from the stop which is less than a predetermined threshold.

11. The method for recovering as claimed in claim 9 comprising:

maintaining the underwater vehicle at a predetermined depth with a substantially zero trim and on a constant course at a constant speed, and positioning said receiving device in alignment with the underwater vehicle.

12. A recovery system for recovering an autonomous underwater vehicle from a ship, said underwater vehicle comprising a front part called a nose, said system comprising:

a receiving device comprising a stop, the nose of the underwater vehicle being capable of bearing thereagainst, blocking means making fixing the underwater vehicle to the stop possible, a flexible connection providing an interface between the receiving device and the ship, the flexible connection being arranged such that the ship pulls the receiving device, stabilization means configured to permit positioning the receiving device at a depth and with a list and a trim of the receiving device, and a ramp providing an interface between the bridge of the ship and a marine environment, the receiving device being capable of sliding on the ramp, the system comprising third guide means, the function thereof being to ensure an alignment of a longitudinal axis of the receiving device with the ramp when said receiving device slides on the ramp, the ramp comprising first bearing means, second bearing means of the receiving device bearing thereagainst when said device is guided by the guide means so as to set a constant incline of the receiving device relative to the ramp about the longitudinal axis of the receiving device.

13. An underwater assembly comprising a recovery system for recovering an autonomous underwater vehicle from a ship, said underwater vehicle comprising a front part called a nose, said system comprising:

a receiving device comprising a stop, the nose of the underwater vehicle being capable of bearing thereagainst, blocking means making fixing the underwater vehicle to the stop possible, a flexible connection providing an interface between the receiving device and the ship, the flexible connection being arranged such that the ship pulls the receiving device, stabilization means configured to permit positioning the receiving device at a depth and with a list and a trim of the receiving device, the underwater assembly also comprising said underwater vehicle, a plate being arranged so as to extend along an entire length of a lateral sonar device protruding from a body of the underwater vehicle.

* * * * *